US006260659B1

(12) United States Patent
Takahashi et al.

(10) Patent No.: US 6,260,659 B1
(45) Date of Patent: Jul. 17, 2001

(54) SILENCER FOR INTERNAL COMBUSTION ENGINE

(75) Inventors: Yasushi Takahashi; Hitoshi Kashiwagi; Hiroaki Jinno; Mutsuo Nakajima; Hidehiko Numata, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/500,996

(22) Filed: Feb. 9, 2000

(30) Foreign Application Priority Data

Feb. 9, 1999 (JP) ..... 11-031748

(51) Int. Cl.[7] ..... F01N 1/00

(52) U.S. Cl. ..... 181/255; 181/227; 181/228; 181/282

(58) Field of Search ..... 181/255, 249, 181/251, 227, 228, 282, 268, 269, 224; 165/52, 154, 157

(56) References Cited

U.S. PATENT DOCUMENTS 4,122,914 * 10/1978 Suyama ..... 181/258
4,124,092 * 11/1978 Kajiya et al. ..... 181/265
4,360,076 * 11/1982 Suyama ..... 181/265
4,516,659 * 5/1985 Hall et al. ..... 181/243
4,971,166 * 11/1990 Hase ..... 181/254
5,107,953 * 4/1992 Shimizu et al. ..... 181/282
5,677,518 * 10/1997 Fischer et al. ..... 181/269

FOREIGN PATENT DOCUMENTS

361169611 * 7/1986 (JP) ..... 181/238

OTHER PUBLICATIONS

Numerical Simulation of Gas Flow in Cylinder with PCC (Partial Cells in Cartesian coordinate) Method–Examination of Mesh Dependence by Yasushi Takahashi et al. from Proceedings of the 12th Symposium of Internal Combustion Engine ('95–7–18–20, Oumiya).

* cited by examiner

*Primary Examiner*—Robert E. Nappi
*Assistant Examiner*—Edgardo San Martin
(74) *Attorney, Agent, or Firm*—Birch, Stewart, Kolasch & Birch, LLP

(57) ABSTRACT

Compactness is enhanced while retaining the performance, noise deadening characteristic and engine output. The ratio of the distance, a, from a gas outlet end, p, of an exhaust pipe to an inner wall of a rear partition wall to an inside diameter ØA of the exhaust pipe is set in a relation of $0.6 \leqq (a/ØA) < 1.2$, while the ratio of the distance, b, from a gas inlet end, q, of a tail pipe to an inner wall of a front partition wall to an inside diameter ØB of the tail pipe is set in a relation of $0.4 \leqq (b/ØB) < 1.2$, to afford a silencer having an optimum combination of engine output characteristic and compactness while retaining a noise deadening effect.

8 Claims, 5 Drawing Sheets

SILENCER FOR INTERNAL COMBUSTION ENGINE

BACKGROUND OF THE INVENTION

1. Field of the Invention

The present invention relates to a silencer for an internal combustion engine suitable for application to a motorcycle or a four-wheeled motor vehicle or the like.

2. Description of Background Art

In an internal combustion engine used in a motorcycle or the like, if an exhaust noise is released as it is into the atmosphere, there occurs an explosive noise. To suppress the generation of such an explosive noise, a silencer is attached to the vehicle for allowing the exhaust gas to pass therethrough and absorbing sound waves to turn down the exhaust noise.

FIG. 6 schematically illustrates a longitudinal sectional configuration of a multi-stage expansion chamber type silencer 1. The silencer 1 has a generally cylindrical silencer body 2. The silencer body 2 comprises a circumferential wall 3, front and rear walls (front and rear partition walls) 4*a*, 4*d* which close the circumferential wall 3, and partition walls 4*b* and 4*c* as intermediate walls. With these walls there are formed first, second and third expansion chambers (first to third chambers) 5*a*, 5*b*, 5*c*.

An exhaust pipe 6 for introducing a gas (also called exhaust gas) G into the silencer body 2 is installed through the front partition wall 4*a* of the silencer body 2, while a tail pipe 9 for discharging the gas G from the interior of the silencer body 2 is installed through the rear partition wall 4*d* of the silencer body. Further, inner pipes 7 and 8 are installed through the intermediate partition walls 4*b* and 4*c*. In FIG. 6, arrows indicate flowing directions of the gas G.

In the silencer 1 shown in FIG. 6, the first to third expansion chambers 5*a* to 5*c* are contiguous to one another in three stages, but the silencer 1 can be expressed by way of a single chamber (single expansion chamber) silencer 12 as a model as illustrated in FIG 7.

As illustrated in FIG 7, the silencer 12 has a generally cylindrical expansion chamber 14 as a silencer body. The expansion chamber 14 is made up of a circumferential wall 16 having an overall length of L and front and rear partition walls 18, 20 which close the circumferential wall 16 and which has a diameter of ØC.

An exhaust pipe 22 with a diameter ØA for introducing the gas G into the expansion chamber 14 is installed through the front partition wall 18 of the expansion chamber 14, while a tail pipe 24 with a diameter of ØB for discharging the gas G from the interior of the expansion chamber 14 is installed through the rear partition wall 20 of the expansion chamber. Also in FIG. 7, arrows indicate a flowing direction of the gas G.

A comparison will now be made between the first expansion chamber 5*a* in the silencer 1 illustrated in FIG. 6 and the silencer 12 as a single chamber model illustrated in FIG. 7. It is seen that the front partition wall 4*a* in the silencer 1 and the front partition wall 18 in the silencer 12 correspond to each other, that the partition wall 4*b* in the silencer 1 and the rear partition wall 20 in the silencer 12 correspond to each other, that the exhaust pipe 6 in the silencer 1 and the exhaust pipe 22 in the silencer 12 correspond to each other, and that the inner pipe 7 in the silencer 1 and the tail pipe 24 in the silencer 12 correspond to each other. Also as to the remaining second and third expansion chambers 5*b*, 5*c* in the silencer 1, they can be expressed likewise by the silencer 12 as a single chamber model illustrated in FIG. 7.

In the silencer 12 of FIG. 7, a noise deadening characteristic, an engine output characteristic (exhaust blow-through characteristic), and compactness are considered to be important points. It is known that the noise deadening characteristic is improved by enlarging the diameter ØA of the exhaust pipe 22 and by shortening the distance, a, from a gas outlet end of the pipe 22 to an inner wall 26 of the rear partition wall 20 and the distance, b, from a gas inlet side of the tail pipe 24 to an inner wall 28 of the front partition wall 18 to increase the flow resistance of the exhaust gas G.

However, in the case where the flow resistance of the exhaust gas G is increased by shortening the distance, from the gas outlet end of the exhaust pipe 22 to the inner wall 26 of the rear partition wall 20 or the distance, b, from the gas inlet end of the tail pipe 24 to the inner wall 28 of the front partition wall 18, there arises the problem that the engine output becomes lower. In other words, there exists a reciprocal relation, so-called trade-off relation, for the noise deadening characteristic such that the exhaust blow-through characteristic of the engine is deteriorated.

In view of the above point and for making a desired noise deadening characteristic and a desired engine output characteristic compatible with each other, the applicant in the present case has experientially designed a silencer so that the ratio of the distance, a, to the diameter ØA of the exhaust pipe 22 and the ratio of the distance, b, to the diameter B of the tail pipe 24 are $(a/ØA) \geqq 1.2$ and $(b/ØB) \geqq 1.2$, respectively.

The length of the exhaust pipe for communication of the expansion chamber (the expansion chamber 5*a* in FIG. 6) located on the most upstream side with an exhaust port of the internal combustion engine (not shown) is related to a torque characteristic relative to the rotational speed of the engine, while the diameter of the tail pipe which is open to the atmosphere from the expansion chamber (the expansion chamber 5*c* in FIG. 6) located on the most downstream side is related to the displacement of the internal combustion engine and the size of a normal rotational speed range.

Therefore, for attaining optimization while taking balance among the three characteristics of noise deadening characteristic, engine output characteristic and compactness, it has so far been required to adjust the distances a and b in each expansion chamber, adjust the overall length L and adjust the diameter of each inner pipe for connection between adjacent expansion chambers.

SUMMARY AND OBJECTS OF THE INVENTION

The present invention has been accomplished taking the above-mentioned problems into account and it is an object of the invention to provide a silencer for an internal combustion engine which permits a further optimization of both engine output characteristic and compactness while ensuring a desired noise deadening characteristic.

According to the present invention there is provided a silencer for an internal combustion engine having a generally hollow, cylindrical expansion chamber constituted of a circumferential wall and front and rear partition walls disposed in front and rear positions with respect to the circumferential wall. An exhaust pipe is disposed through the front partition wall to introduce a gas into the expansion chamber. A tail pipe disposed through the rear partition wall to discharge the gas from the interior of the expansion chamber. An inside diameter of the exhaust pipe is assumed to be ØA and the distance from a gas outlet end of the exhaust pipe to an inner wall of the rear partition wall is assumed to be a, the inside diameter ØA and the distance, a, are in a relation of $0.6 \leqq (a/ØA) < 1.2$.

According to the invention just described above, by setting the relation between the exhaust pipe inside diameter ØA and the distance, a, from the exhaust pipe gas outlet end to the inner wall of the rear partition wall at $0.6 \leqq (a/ØA) < 1.2$, there can be obtained a silencer having an optimum combination of engine output characteristic and compactness while ensuring a desired noise deadening characteristic.

Further, by setting relation between the tail pipe inside diameter ØB and the distance, b, from the tail pipe gas inlet end to the inner wall of the front partition wall at $0.25 \leqq (b/ØB) < 1.2$, there can be obtained a silencer having an excellent combination of engine output characteristic and compactness while ensuring a desired noise deadening characteristic.

In the present invention, by forming the gas inlet end of the tail pipe in a bellmouth shape, the expansion chamber and hence the silencer body can be made compact while ensuring desired noise deadening performance and engine output characteristic.

In the present invention, by setting the relation between the inside diameter ØB and the distance, b, at $0.4 \leqq (b/ØB) < 1.2$, there can be obtained a silencer having an optimum combination of engine output characteristic and compactness while ensuring a desired noise deadening effect.

Further, in the case of changing the dimensional relation between the exhaust pipe and the tail pipe, by maintaining the relation of the inside diameter ØB and the distance, b, to the inside diameter ØA and the distance, a, at $(b/ØB) \leqq (a/ØA)$, it is possible to make a further improvement of compactness while ensuring desired noise deadening effect and engine output characteristic.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An analysis model adopted in the present invention will be described hereinunder with reference to the drawings.

Figure 1:
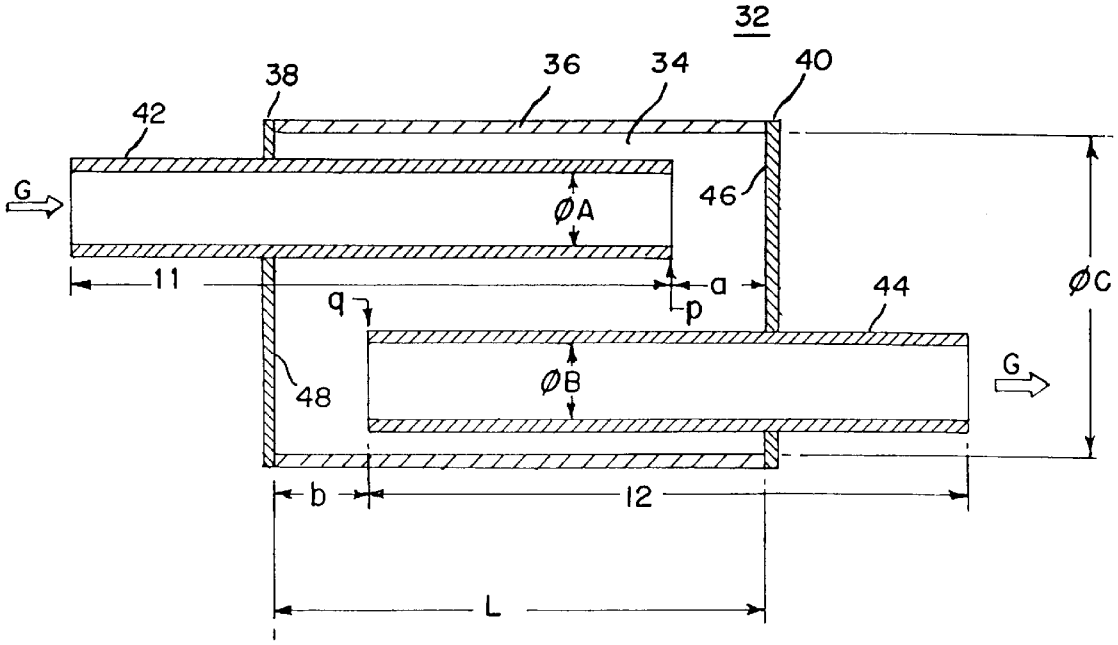
FIG. 1 is a schematic sectional view of a silencer according to an embodiment of the present invention.

FIG. 1 shows a schematic sectional configuration of a silencer 32 embodying the present invention. The silencer 32 is provided with a cylindrical expansion chamber (also merely designated chamber) 34 as a silencer body having an internal overall length (also designated an external size for convenience'sake) of L and an inside diameter of ØC. The expansion chamber 34 is made up of a circumferential wall 36 and front and rear partition walls 38, 40 which close the circumferential wall 36.

An exhaust pipe 42 for introducing a gas (also designated exhaust gas) G into the expansion chamber 34 is installed through the front partition wall 38 of the expansion chamber 34, the exhaust pipe 42 having a diameter of ØA and a length of 11, while a tail pipe 44 for discharging the gas G from the interior of the expansion chamber 34 is installed-through the rear partition wall 40 of the expansion chamber 34, the tail pipe 44 having a diameter of ØB and a length of 12. In FIG. 1, arrows indicate a flowing direction of the gas G.

In the silencer 32 of such a configuration, a noise deadening characteristic, an engine output characteristic (exhaust gas blow-through characteristic) and compactness are considered to be important points, as noted previously. As to the noise deadening characteristic, the smaller the diameter ØA of the exhaust pipe 42, the more improved the same characteristic.

It is also known that the noise deadening characteristic is improved by shortening the distance (also designated blow-off portion distance), a, from a gas outlet end (pipe end), p, of the exhaust pipe 42 to an inner wall 46 of the rear partition wall 40 or the distance (also called suction portion distance) , b, from a gas inlet end (pipe end), q, of the tail pipe 44 to an inner wall 48 of the front partition wall 38 and thereby increasing the flow resistance of the exhaust gas G. However, an increase of the flow resistance causes deterioration of the exhaust gas blow-through characteristic.

Figure 6:
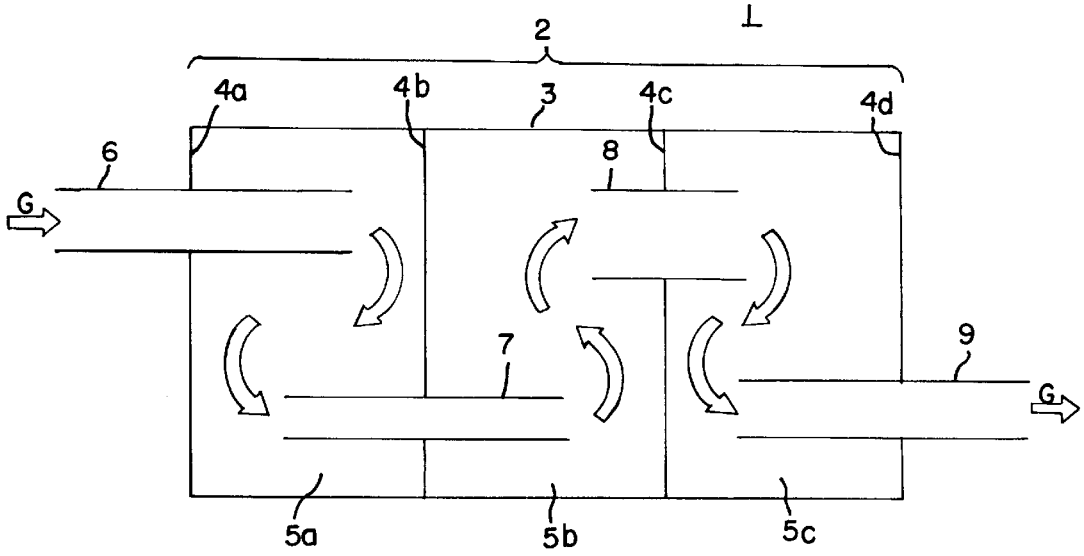
FIG. 6 PRIOR ART
FIG. 6 is a schematic sectional diagram showing a schematic configuration in a longitudinal direction of a multi-stage expansion chamber type silencer.
Figure 7:
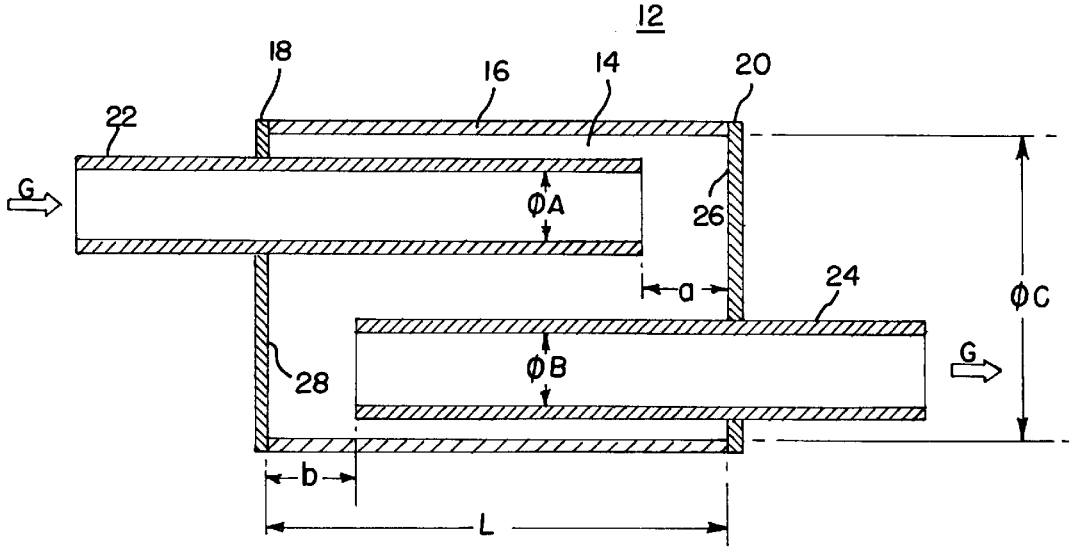
FIG. 7 PRIOR ART
FIG. 7 is a schematic sectional diagram for explaining a conventional silencer.

Simulative calculations will be described below to determine an optimum range of the distance, a, to diameter ØA ratio (a/ØA) and an optimum range of the distance, b, to diameter ØB ratio (b/ØB) which have heretofore been determined experientially. Using as morphological data a solid model prepared by a three-dimensional CAD system such as CATIA, the simulative calculations were conducted in accordance with a PCC (Partial Cells in cartesian coordinate) method {12th Internal Combustion Engine Symposium Record (1995, pp.91–96), Yasumoto Takahashi and Hitoshi Fujii}. Simulation results which will be described below are also applicable to each of the expansion chambers 5*a* to 5*c* in the multi-stage silencer 1 shown in FIG. 6.

Simulation 1: Exhaust gas blow-through characteristic related to the exhaust pipe 42

First, with respect to the model of the single chamber silencer (unit silencer) 32 shown in FIG. 1, the overall length L and dimensions of the tail pipe 4—4 are fixed, while the ratio of the distance, a, from the gas outlet end, p, of the exhaust pipe 42 to the inner wall (also designated partition wall hereinafter) 46 to the inside diameter ØA of the exhaust pipe, i.e., (a/ØA), is used as a variable, and in this condition the exhaust gas blow-through characteristic is calculated.

Likewise, exhaust gas blow-through characteristics were calculated in various combinations of the diameter ØA of the exhaust pipe and the diameter ØB of the tail pipe 44.

Figure 2:
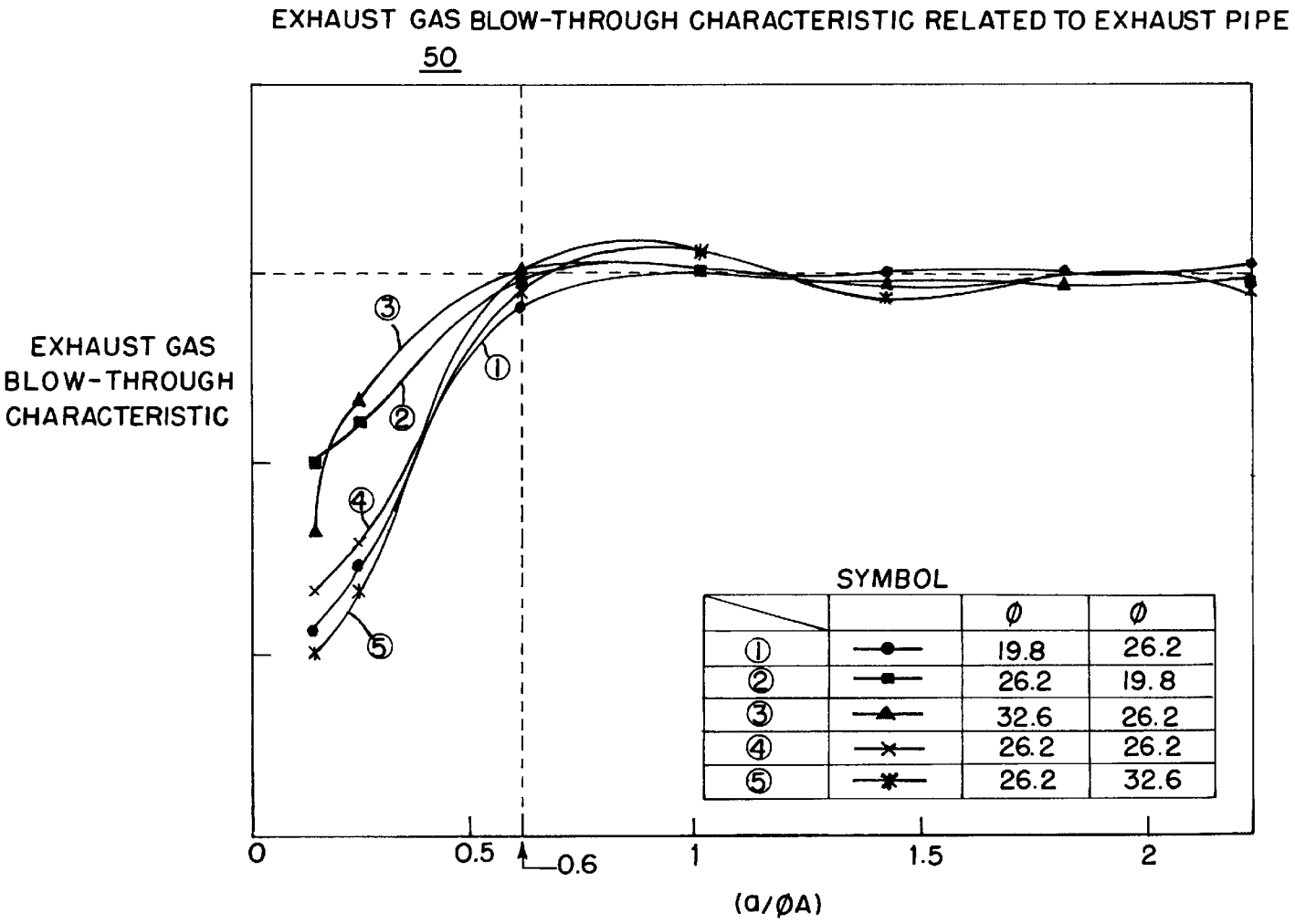
FIG. 2 is an exhaust gas blow-through characteristic diagram related to an exhaust pipe.

FIG. 2 shows the results of calculation made with respect to the relation between the value of the ratio of the distance, a, from the gas outlet end, p, to the partition wall 46 to the diameter ØA of the exhaust pipe 42, i.e., (a/ØA) , and the exhaust gas blow-through characteristic. In the same figure, the values of an exhaust gas blow-through characteristic 50 comprising characteristics 1 to 5 which are circled have been obtained by making gas flow rates per unit time dimensionless. Combinations of the diameter ØA of the exhaust pipe 42 and the diameter ØB of the tail pipe, which are tabulated in FIG. 2, are as follows. Characteristic 1:ØA=19.8, ØB =26.2, characteristic 2:ØA=26.2, ØB=19.8, characteristic 3:ØA=32.6, ØB=26.2, characteristic 4:ØA=ØB.=26.2, characteristic 5:ØA=26.2, ØB=32.6.

In the graph of the exhaust gas blow-through characteristic 50 shown in FIG. 2, the right-hand side (larger in a/ØA ratio) of the graph represents a state in which the distance, a, from the gas outlet end, p, to the partition wall 46 is the longest, while the left-hand side in the same figure represents a state in which the closer to the left-hand side (a smaller side of a/ØA) in FIG. 2, the more extended the gas outlet end, p, to the partition wall 46 side to make the distance, a, smaller.

Reference to FIG. 2 shows that the exhaust gas blow-through characteristic 50 related to the exhaust pipe 42 is deteriorated abruptly at a ratio value of (a/ØA)≦0.6 and becomes nearly stable and undergoes little variation at a ratio value of (a/ØA)=0.6 or more.

As to the degree of deterioration in the exhaust gas blow-through characteristic at a ratio value of (a/ØA)≦0.6, it can be read from a comparison of characteristics 1, 3 and 4 that when the diameter ØB of the tail pipe 44 is constant (ØB=26.2 mm), the smaller the diameter ØA of the exhaust pipe 42, the gentler the deterioration (ØA=19.8, 32.6, and 26.2 in characteristics 1, 3 and 4, respectively), and that the larger the diameter ØB, the more delayed the state of characteristic deterioration.

Further, from a comparison of characteristics 2, 4 and 5 it is seen that the start of characteristic deterioration is constant independently of the diameter ØB of the tail pipe 44 (ØB=19.8, 26.2, and 32.6 in characteristics 2, 4 an 5, respectively), but that as the diameter ØB becomes larger, a wavy variation occurs at a ratio value of (a/ØA) ≦0.6 and stability is deteriorated.

As to the noise deadening characteristic, it is a matter of course, without the need of calculation, that the smaller the ratio value (a/ØA), the more outstanding the noise deadening effect, so the above calculation results show that even if the ratio value (a/ØA) is set still smaller than the conventional experiential ratio value (a/ØA) of 1.2, it is possible to attain a satisfactory noise deadening-effect, compactness, and a further optimization while preventing the deterioration of output characteristic.

From the above calculations and studies it is seen that an optimum value of the ratio of the distance, a, from the gas outlet end, p, to the partition wall 46 to the diameter ØA of the exhaust pipe 42 can be obtained from the following expression (1)

$$(a/ØA)=0.6. \quad (1)$$

In the case where the silencer is to be provided less expensively while taking a mass-production error into account, a suitable value may be determined in the range of the following expression (2):

$$0.6 \leqq (a/ØA) \leqq 1.2. \quad (2)$$

Where the silencer is to be manufactured in a process of a relatively high accuracy and a small mass production error and when the noise deadening effect is to be enhanced without changing the external size of the silencer or when the size of the silencer is to be further reduced, the silencer may be designed in the range of the following expression:

$$0.6 \leqq (a/ØA) \leqq 0.8. \quad (3)$$

Simulation 2: Exhaust gas blow-through characteristic related to the tail pipe 44.

First, with respect to the model of the single chamber silencer (unit silencer) 32 shown in FIG. 1, the overall length L and sizes of the exhaust pipe 42 are fixed, while the value of the ratio of the distance, b, from the gas inlet end, q, of the tail pipe 44 to the inner wall (partition wall) 48 to the diameter ØB, i.e., (b/ØB), is used as a variable, and there was calculated an exhaust gas blow-through characteristic (suction characteristic).

Likewise, exhaust gas blow-through characteristics were calculated in various combinations of the diameter ØA of the exhaust pipe 42 and the diameter ØB of the tail pipe 44.

Figure 3:
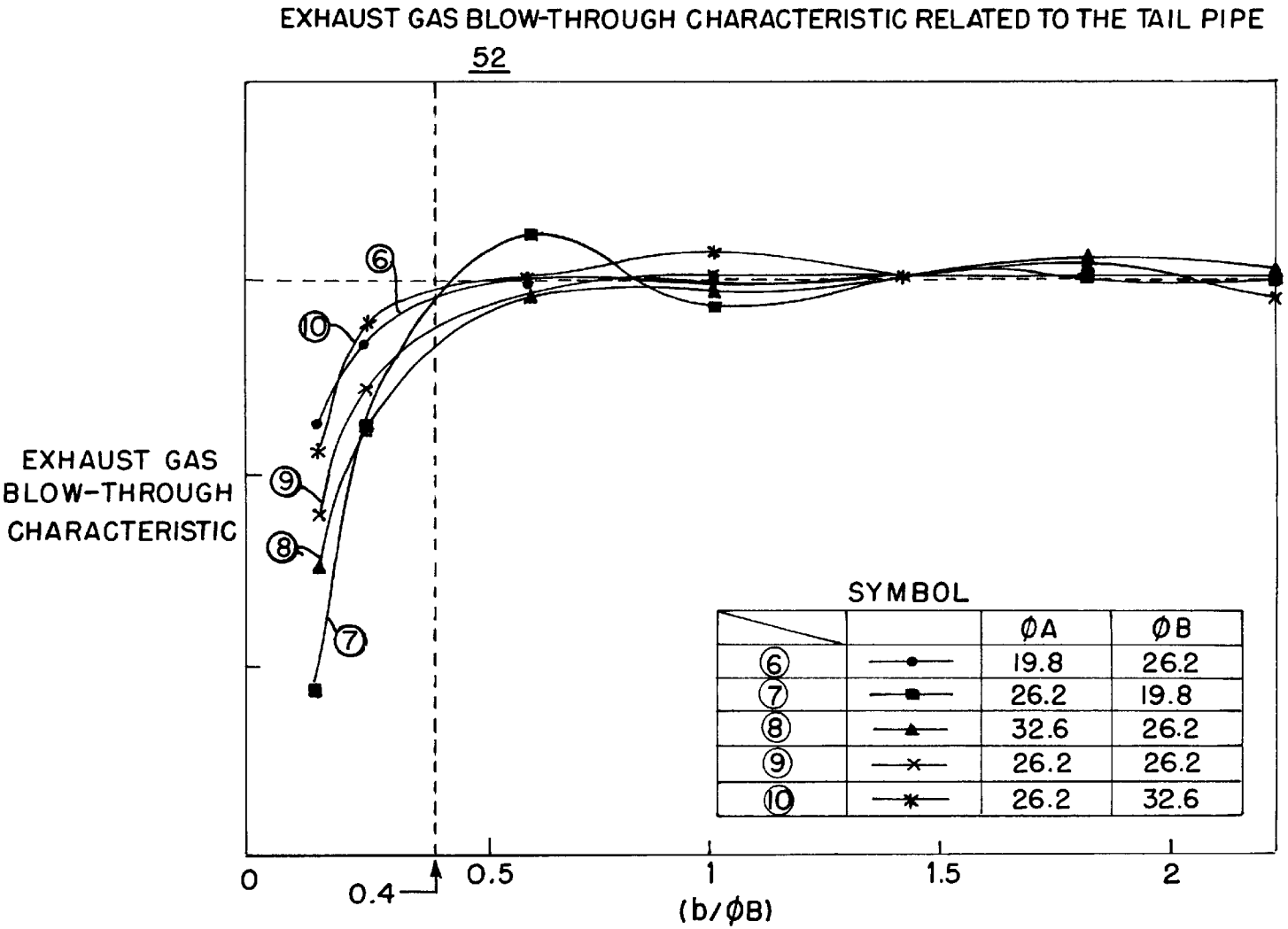
FIG. 3 is an exhaust gas blow-through characteristic diagram related to a tail pipe.

FIG. 3 shows the results of calculation made with respect to the relation between the value of the ratio of the distance, b, from the gas inlet end, q, to the inner wall (also designated partition wall) 48 to the diameter ØB of the tail pipe 44, i.e., (b/ØB), and an exhaust gas blow-through characteristic 52. The values of the exhaust gas blow-through characteristic 52 (6 to 10 which are circled) have been obtained by making gas flow rates per unit time dimensionless. Combinations of the diameter ØA of the exhaust pipe 42 and the diameter ØB of the tail pipe 44, which are tabulated in FIG. 3, are as follows.

Characteristic 6:ØA=19.8, ØB=26.2, characteristic 7: ØA=26.2, ØB=19.8, characteristic 8:ØA=32.6, ØB=26.2, characteristic 9:ØA=ØB=26.2, characteristic 10:ØA=26.2, ØB=32.6. In the graph of the, exhaust gas blow-through characteristic 52 shown in FIG. 3, the right-hand side (larger in b/ØB ratio) of the graph represents a state in which the distance, b, from the gas inlet end, q, to the partition wall 48 is the longest, while the left-hand side in the same figure represents a state in which the closer to the left-hand side (a smaller side of b/ØB) in FIG. 3, the more extended the gas inlet end, q, to the partition wall 48 side to make the distance, b, shorter.

From FIG. 3 it is seen that the exhaust gas blow-through characteristic 52 related to the tail pipe 44 is deteriorated abruptly at a ratio value of (b/ØB)≦0.4 and becomes nearly stable and undergoes little variation at a ratio value of (b/ØB)≧0.4.

Moreover, from a comparison of characteristics 6, 8 and 9 it is seen that when the diameter ØB of the tail pipe 44 is constant, the smaller the diameter ØA of the exhaust pipe 42, the less influential is a change of the ratio value (b/ØB), and the larger the diameter ØA, the greater the influence.

Further, from a comparison of characteristics 7, 9 and 10 it is seen that when the diameter ØA of the exhaust pipe 42 is constant, then as the diameter ØB of the tail pipe 44 becomes smaller, a wavy variation occurs at a ratio value of (b/ØB)=0.4 or more and stability is deteriorated.

Also in this case, as to the noise deadening characteristic, the smaller the ratio value (b/ØB), the more outstanding the noise deadening effect. This is a matter of course without the need of calculation. Thus, the above calculation results indicate that even if the ratio value (b/ØB) is set still smaller than the conventional experiential ratio value (b/ØB) of 1.2, it is possible to attain a satisfactory noise deadening effect, compactness, and a further optimization while preventing the deterioration of output characteristic.

From the above calculations and studies it is seen that an optimum value of the ratio of the distance, b, from the gas inlet end, q, to the partition wall 48 to the diameter ØB of the tail pipe 44 can be obtained from the following expression (4)

$$(b/ØB)=0.4. \quad (4)$$

Where the silencer is to be provided less expensively while taking a mass-production error into consideration, a suitable value may be determined in the range of the following expression (5):

$$0.4 \leqq (b/ØB) \leqq 1.2 \quad (5)$$

Where the silencer is to be manufactured in a process of a relatively high accuracy and a small mass production error and when the noise deadening effect is to be enhanced without changing the external size of the silencer or when the size of the silencer is to be further reduced, the silencer may be designed in the range of the following expression:

$$0.4 \leqq (b/ØB) \leqq 0.8 \quad (6)$$

Where the silencer 32 is designed under the conditions of ØA≠ØB and a≠b based on the above expressions (4) and (1), the silencer may be designed so as to satisfy the following expression (7):

$$0.4 \leqq (b/ØB) \leqq (a/ØA) \leqq 1.2 \quad (7)$$

provided $0.6 \leqq (a/ØA)$.

Simulation 3: Exhaust gas blow-through characteristic related to the tail pipe 44B having a bellmouth shape (see FIG. 4)

In connection with the calculation results obtained in the above simulations 1 and 2, the present inventors have taken note of the point that a wavy phenomenon occurs in a stable region of characteristic when the diameter ØB of the tail pipe 44 is changed, and has suspected that this may be because the gas flow is not smoothly sucked in at the gas inlet end, q, of the tail pipe 44. The gas flow can be made smooth by forming the gas inlet end, q, of the tail pipe 44 in a bellmouth shape. Adoption of a bellmouth shape results in an increase of the opening diameter of the gas inlet end, q, and therefore the area of a cylindrical surface described imaginarily by both pipe diameter ØB and partition wall 48 becomes larger, whereby the exhaust gas blow-through characteristic is presumed to be improved while the distance, b, remains the same.

Figure 4:
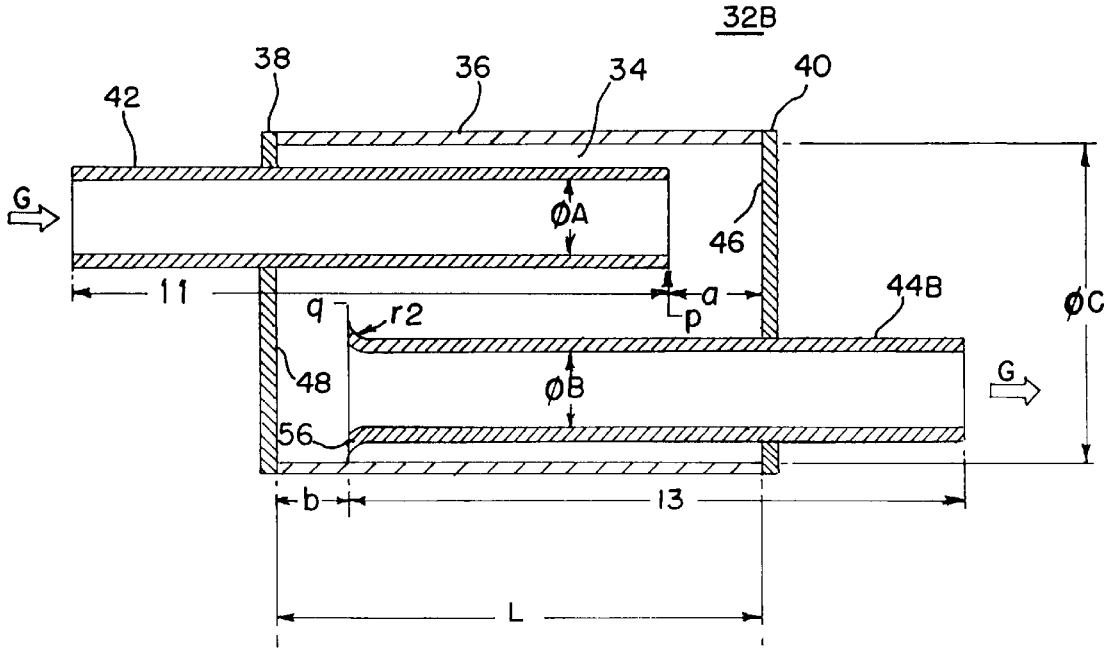
FIG. 4 is a schematic sectional diagram of a silencer having a bellmouth-shaped tail pipe according to another embodiment of the present invention.

FIG. 4 is a schematic diagram of a silencer 32B having a tail pipe 44B which has been obtained by adding a bellmouth shape 56 of radius r2 to the gas inlet end, q, of the tail pipe 44 described above.

There was calculated an exhaust gas blow-through characteristic (suction characteristic) using a ratio value (b/ØB) as a variable under the condition that the diameter ØA of the exhaust pipe 44 and the diameter ØB of the tail pipe 44B are equal to each other (ØA=ØB) and that the distance, b, from the gas inlet end (bellmouth inlet end), q, of the tail pipe 44B is made variable.

Two values were calculated for a case where the radius r2 of the bellmouth shape 56 was set at about a quarter of the diameter ØB of the tail pipe 44B and a case where the radius r2 was set at about a half of the diameter ØB.

Figure 5:
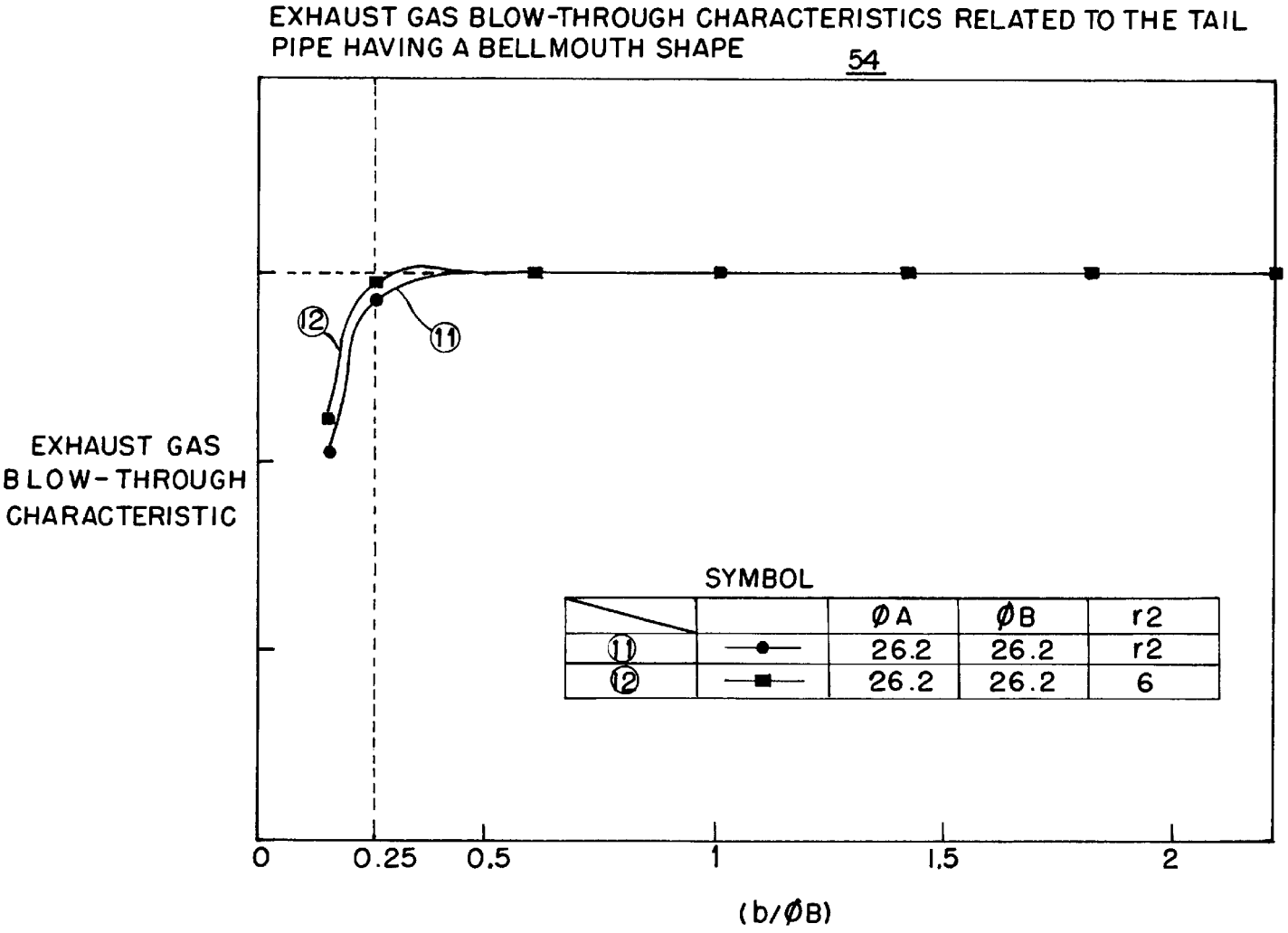
FIG. 5 is an exhaust gas blow-through characteristic diagram related to the bellmouth-shaped tail pipe.

FIG. 5 shows the results of calculation made with respect to the relation between the ratio of the distance, b, from the gas inlet end, q, to the partition wall 48 to the diameter ØB of the tail pipe 44B having the bellmouth shape, i.e., (b/ØB), and an exhaust gas blow-through characteristic 54. The values of the exhaust gas blow-through characteristic (characteristics 11 and 12 which are circled) have been obtained by making gas flow rates per unit time dimensionless. Combinations of the diameter ØA of the exhaust pipe 42, the diameter ØB of the tail pipe 44B and the radius r2 of the bellmouth shape 56, which are tabulated in FIG. 5, are as follows.

Characteristic 11:ØA=ØB=26.2, r2=12 mm, characteristic 12:ØA=ØB=26.2, r2=6.

As is apparent from the characteristics 11 and 12 shown in FIG. 5, in comparison with the characteristics shown in FIG. 3, not only wavy phenomena observed in the characteristics have all been extinguished, but also it turned out that there does not occur a deterioration of characteristic down to near the value of 0.25 which is a far smaller value than the conventional experiential ratio value (b/ØB) of 1.2.

It also turned out that a very large value of the radius r2 of the bellmouth shape 56 is not always good, but that an appropriate radius value is a quarter or so of the diameter ØB of the tail pipe 44B,{r2=ØB×(¼)}.

From the above calculations and studies it is seen that an optimum value of the ratio of the distance, b, from the gas inlet end, q, to the partition wall 48 to the diameter ØB of the tail pipe 44B having a bellmouth shape is obtained by the following expression (8):

$$(b/ØB)=0.25 \quad (8)$$

Where the silencer is to be provided less expensively, taking a mass-production error into account, the (b/ØB) ratio may be set in the range of the following expression (9):

$$0.25 \leqq (b/ØB) \leqq 1.2 \quad (9)$$

Further, where the silencer can be manufactured in a process of a relatively high accuracy and a small mass production error and when the noise deadening effect is to be enhanced without changing its external size or when a further reduction in size of the silencer is to be attained, the silencer may be designed in the range of the following expression (10)

$$0.25 \leqq (b/ØB) \leqq 0.8 \quad (10)$$

It is off course that the present invention is not limited to the above embodiments, but may adopt various other configurations insofar as they do not depart from the gist of the invention.

According to the present invention, as set forth above, it is possible to improve compactness while retaining the performance (noise deadening characteristic and engine output characteristic) required for a silencer.

As a result, there can be attained such derivative effects as enhancing the freedom of vehicular design and drafting of a vehicle equipped with a silencer such as a motorcycle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A silencer for an internal combustion engine, comprising:

a generally hollow, cylindrical expansion chamber constituted by a circumferential wall and front and rear partition walls disposed in front and rear positions with respect to said circumferential wall;

an exhaust pipe disposed through said front partition wall to introduce a gas into said expansion chamber; and a tail pipe disposed through said rear partition wall to discharge the gas from the interior of said expansion chamber;

wherein when an inside diameter of said exhaust pipe is assumed to be ØA and the distance from a gas outlet end of said exhaust pipe to an inner wall of said rear partition wall is assumed to be a, the inside diameter ØA and the distance, a, are in a relation to $0.6 \leqq (a/ØA) \leqq 1.2$.

2. A silencer for an internal combustion engine, comprising:

a generally hollow, cylindrical expansion chamber constituted of a circumferential wall and front and rear partition walls;

an exhaust pipe disposed through said front partition wall to introduce a gas into said expansion chamber, and a tail pipe disposed through said rear partition wall to discharge the gas from the interior of said expansion chamber;

wherein when an inside diameter of said tail pipe is assumed to be ØB and the distance from a gas inlet end of said tail pipe to an inner wall of said front partition wall is assumed to be b, the inside diameter ØB and the distance, b, are in a relation of $0.25 \leqq (b/ØB) \leqq 1.2$.

3. The silencer for an internal combustion engine according to claim 2, wherein said gas inlet end of said tail pipe has a bellmouth shape.

4. The silencer for an internal combustion engine according to claim 2, wherein said inside diameter ØB and said distance, b, are in a relation of $0.4 \leqq (b/ØB) < 1.2$.

5. The silencer for an internal combustion engine according to claim 1, wherein when an inside diameter of said exhaust pipe is ØA, the distance from a gas outlet end of said exhaust pipe to an inner wall of said rear partition wall is a, an inside diameter of said tail pipe is ØB, and the distance from a gas inlet end of said tail pipe to an inner wall of said front partition wall b, the inside diameter ØB and the distance, b, are in the following relation to the inside diameter ØA and the distance, a, :$(b/ØB) \leqq (a/ØA)$.

6. The silencer for an internal combustion engine according to claim 2, wherein when an inside diameter of said exhaust pipe is ØA, the distance from a gas outlet end of said exhaust pipe to an inner wall of said rear partition wall is a, an inside diameter of said tail pipe is ØB, and the distance from a gas inlet end of said tail pipe to an inner wall of said front partition wall b, the inside diameter ØB and the distance, b, are in the following relation to the inside diameter ØA and the distance, a, :$(b/ØB) \leqq (a/ØA)$.

7. The silencer for an internal combustion engine according to claim 3, wherein when an inside diameter of said exhaust pipe is ØA, the distance from a gas outlet end of said exhaust pipe to an inner wall of said rear partition wall is a, an inside diameter of said tail pipe is ØB, and the distance from a gas inlet end of said tail pipe to an inner wall of said front partition wall b, the inside diameter ØB and the distance, b, are in the following relation to the inside diameter ØA and the distance, a, :$(b/ØB) \leqq (a/ØA)$.

8. The silencer for an internal combustion engine according to claim 4, wherein when an inside diameter of said exhaust pipe is ØA, the distance from a gas outlet end of said exhaust pipe to an inner wall of said rear partition wall is a, an inside diameter of said tail pipe is ØB, and the distance from a gas inlet end of said tail pipe to an inner wall of said front partition wall b, the inside diameter ØB and the distance, b, are in the following relation to the inside diameter ØA and the distance, a, :$(b/ØB) \leqq (a/ØA)$.

* * * * *